US008313615B2

(12) United States Patent
De Vroome et al.

(10) Patent No.: US 8,313,615 B2
(45) Date of Patent: Nov. 20, 2012

(54) DEVICE FOR MOISTENING A PAPER WEB, CORRESPONDING ROTARY PRINTING PRESS AND MOISTENING METHOD

(75) Inventors: Clemens De Vroome, Beugen (NL); Adrianus De Cock, Rykevoort de Walsert (NL); Pieter Storm, Cuyk (NL)

(73) Assignee: Goss Contweb B.V., Boxmeer (NL)

( * ) Notice: Subject to any disclaimer, the term of this patent is extended or adjusted under 35 U.S.C. 154(b) by 30 days.

(21) Appl. No.: 12/733,637

(22) PCT Filed: Feb. 22, 2007

(86) PCT No.: PCT/EP2007/001536

§ 371 (c)(1), (2), (4) Date: Nov. 29, 2010

(87) PCT Pub. No.: WO2008/101516

PCT Pub. Date: Aug. 28, 2008

(65) Prior Publication Data

US 2011/0094693 A1 Apr. 28, 2011

(51) Int. Cl.
*D21H 11/00* (2006.01)

(52) U.S. Cl. ..... 162/265; 162/135

(58) Field of Classification Search ..... 162/265, 162/135; 118/258

See application file for complete search history.

(56) References Cited

U.S. PATENT DOCUMENTS

| | | | | |
|---|---|---|---|---|
| 6,827,781 | B1 | 12/2004 | Hahne et al. | 118/630 |
| 6,923,121 | B2 | 8/2005 | De Vroome | 101/488 |

FOREIGN PATENT DOCUMENTS

| | | | |
|---|---|---|---|
| DE | 26 05 895 | A1 | 9/1976 |
| DE | 31 15 958 | | 12/1982 |
| DE | 86 33 956 | U1 | 4/1988 |
| DE | 43 24 337 | A1 | 1/1995 |
| DE | 199 50 009 | A1 | 4/2001 |
| EP | 1 285 754 | A | 2/2003 |

OTHER PUBLICATIONS

DE 43 24 337, machine translation, Jan. 1995.*

See EPO machine translation of claims and specification of DE 2605895, Sep. 1976.

See EPO machine translation of claims and specification of DE 8633956, Apr. 1988.

"In der Praxis: Elektrostatische Wiederbefeuchtung im Heatset-Rollenoffsetdruck," Deutscher Drucker 28, No. 41, Nov. 5, 1992.

* cited by examiner

*Primary Examiner* — Mark Halpern

(74) *Attorney, Agent, or Firm* — Davidson, Davidson & Kappel, LLC

(57) ABSTRACT

This device for applying a moistening liquid to a paper web includes a liquid applicator roller (44, 46) for applying the moistening liquid (38) on the paper web (18). The liquid applicator roller includes an application surface (60), and is characterized in that the application surface (60) is formed of a material capable of creating a corona effect on the paper web by discharge of static electricity between the surface and the paper web (18). Application to paper web dryers of rotary offset presses.

6 Claims, 4 Drawing Sheets

DEVICE FOR MOISTENING A PAPER WEB, CORRESPONDING ROTARY PRINTING PRESS AND MOISTENING METHOD

This application is a 371 of PCT/EP2007/001536 filed 22 Feb. 2007.

The present invention relates to a device for applying a moistening liquid to a paper web, comprising a liquid applicator roller for applying the moistening liquid on the paper web at a liquid application zone, the liquid applicator roller comprising an application surface.

BACKGROUND

In the state of the art, devices are known for applying moistening liquid on paper webs. The moistening devices usually comprise an applicator roller that is used to transfer the moistening liquid from a liquid tank to the paper web.

As the application roller is in direct contact with the paper web carrying ink, ink build-up has been noticed on the application roller.

A number of measures have been taken in order to reduce this ink build-up on the applicator roller. For example the moistening liquid used is a mixture of silicone and water.

However, the known devices are still subject to ink build-up on the applicator roller.

SUMMARY OF THE INVENTION

Also, the amount of moistening liquid transferred from the applicator roller to the paper web needs to be as high as possible.

It is an object of the present invention to reduce the ink build-up on the applicator roller and to improve the transfer of liquid from the applicator roller to the paper web.

The present invention provides a device, characterized in that the device comprises means for creating a corona effect by discharge of static electricity on the paper web upstream of the liquid application zone.

Further improvements according to specific embodiments of the invention comprise the following features:

- the means for creating a corona effect comprise the application surface, this surface being formed of a material capable of creating the corona effect on the paper web between the application surface and the paper web;
- the material is a plastics material;
- the material contains Fluorine, in particular the material consists of Poly-tetra-fluorine-ethylene (PTFE);
- the device is adapted to convey the paper web (18) in a paper web travel direction (D), and the device is adapted to rotationally drive the applicator roller in a roller direction against the paper web travel direction; and
- that the liquid applicator roller comprises an outer layer defining the application surface and made of the material capable of creating the corona effect and an inner core made of a material that is different from the material of the outer layer.

Another object of the invention is a rotary printing press having at least one chill roll for a paper web adapted to cool a first side of the paper web, characterized in that it comprises a device for applying a moistening liquid to said first side of the paper web, and in that the device is a device as defined above.

The rotary printing press according to specific embodiments of the invention comprise the following features:

- the applicator roller of the device is arranged upstream of the chill roll in the paper web travel direction; and the applicator roller is arranged downstream of the chill roll in the paper web travel direction.

The invention relates also to a method of applying moistening liquid on a paper L 5 web, characterised in that it comprises the following steps:

- driving a paper web in a paper web travel direction,
- rotating a liquid applicator roller,
- applying a moistening liquid with the liquid applicator roller to the paper web in a liquid application zone and
- creating a corona of discharge of static electricity in a zone of the paper web in a zone upstream of the liquid application zone.

BRIEF DESCRIPTION OF THE DRAWINGS

The invention will be best understood in light of the following description of a specific, non-limiting embodiment of the invention. The description refers to the annexed drawings, which show:

On FIG. 1 a schematic side view of a rotary printing press according to the invention, On FIG. 2 a part of the chill roll assembly of the press of FIG. 1, On FIG. 3 a schematic view of the moistening device of the press of FIG. 1, and On FIG. 4 an enlarged schematic side view of an applicator roller and a paper web of the press of FIG. 1.

DETAILED DESCRIPTION

Figure 1:
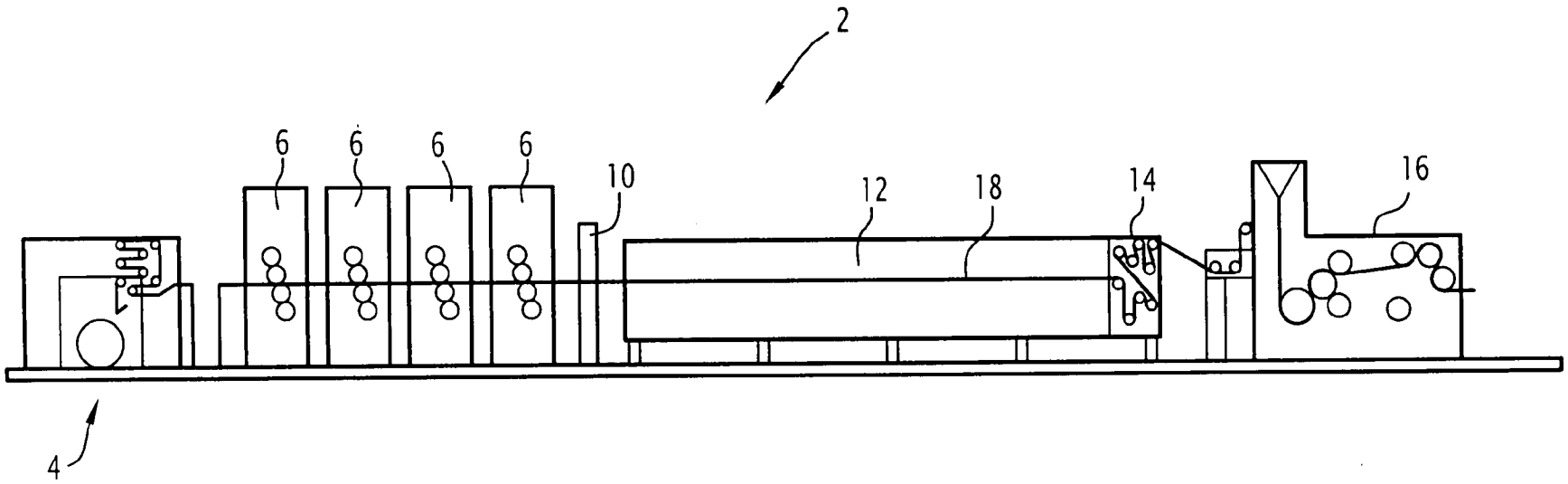

FIG. 1 shows a web-fed offset printing press according to the invention, designated by the general reference 2.

The printing press 2 comprises a splicer 4, four printing units 6, a web catcher 10, a hot air dryer 12, a chill roll assembly 14 and a folder 16.

The rotary printing press 2 comprises also a paper web 18, which travels through the press 2 along a paper web travel direction D from the splicer 4, through the printing units 6, the web catcher 10, the hot air dryer 12, and the chill roll assembly 14 to the folder 16.

Figure 2:
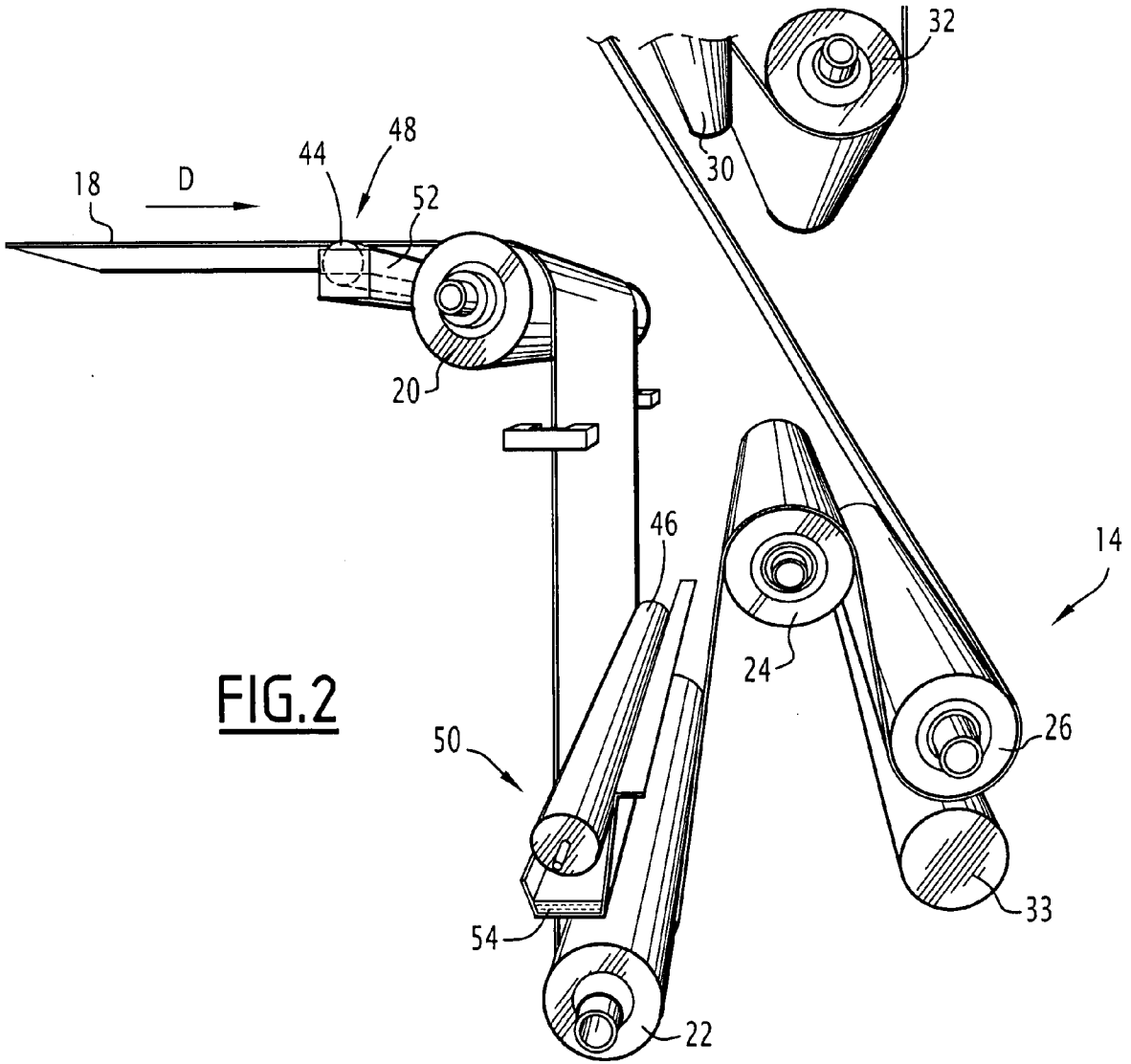

Part of the chill roll assembly 14 is depicted in FIG. 2. The chill roll assembly 14 comprises nine chill rolls of which six chill rolls 20, 22, 24, 26, 30 and 32 are visible on FIG. 2.

The chill roll assembly 14 comprises also a nip roll 33 cooperating with chill roll 26.

Figure 3:
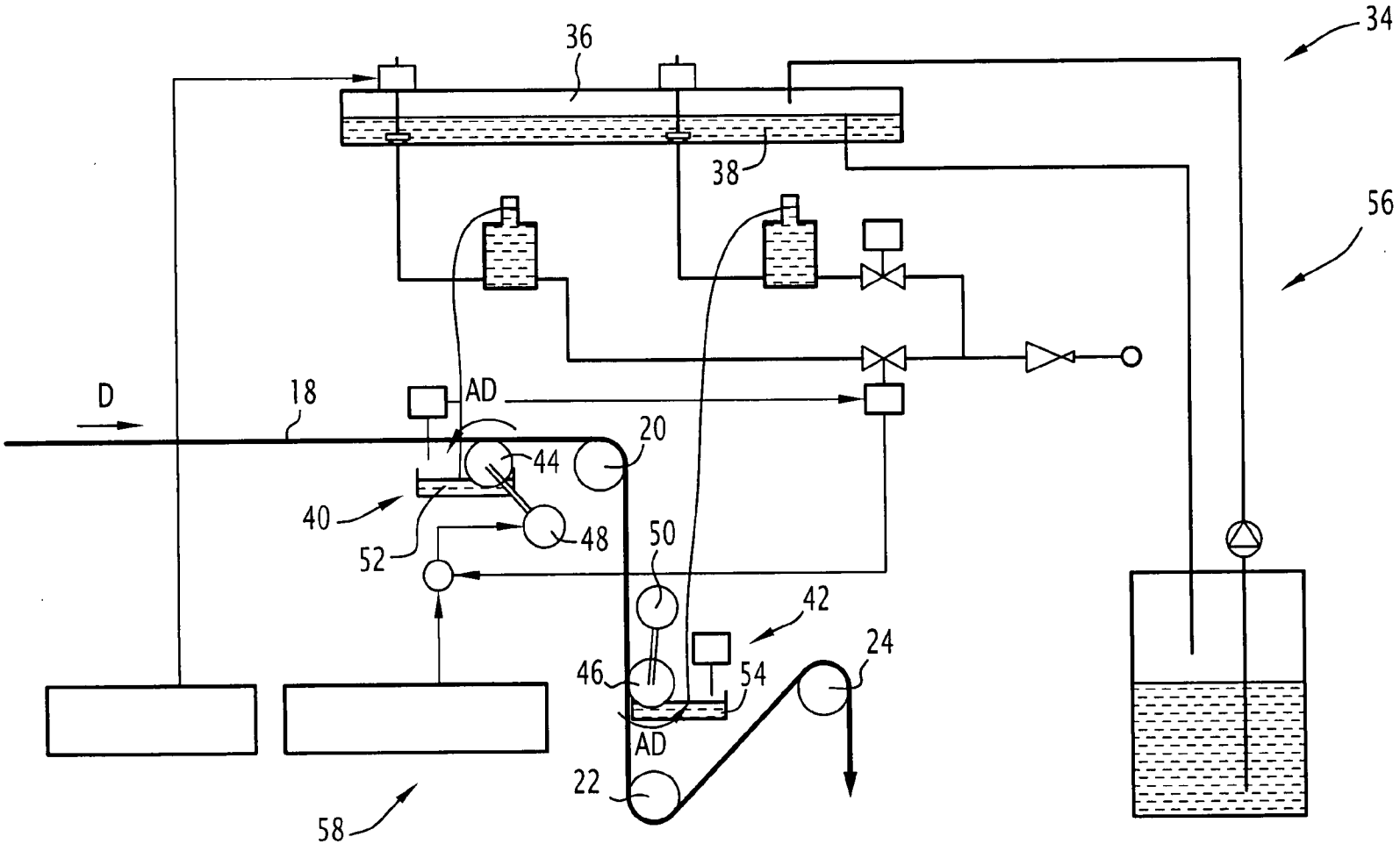

As can be seen on FIG. 3, the printing press 2 is furthermore equipped with a moistening device 34 which is adapted to apply a moistening liquid 38 to the paper web 18. The moistening device 34 comprises a liquid tank 36 which contains the moistening liquid 38, which is in the present case a mixture of water and silicone.

Two applicator assemblies 40, 42 are adapted to apply the moistening liquid 38 to the paper web 18. The applicator assembly 40 is adapted to apply the liquid to a first side of the paper web 18 and the applicator assembly 42 is adapted to apply liquid to a second side of the paper web 18.

Each applicator assembly 40, 42 has an applicator roller 44, 46, which is rotationally driven by a motor 48, 50 in an applicator roller direction AD. The direction AD is counter clockwise in FIGS. 2 to 4. Each applicator assembly 40, 42 has a moistening liquid bath 52, 54 which contains an exactly defined amount of moistening liquid 38 and in which the applicator roller 44, 46 is partially immerged.

The level of moistening liquid 38 in the moistening liquid baths 52, 54 with respect to the applicator rollers 44, 46 is regulated by a regulation mechanism 56. The rotational speed of the applicator rollers 44, 46 is regulated by a motor regulation device 58.

Figure 4:
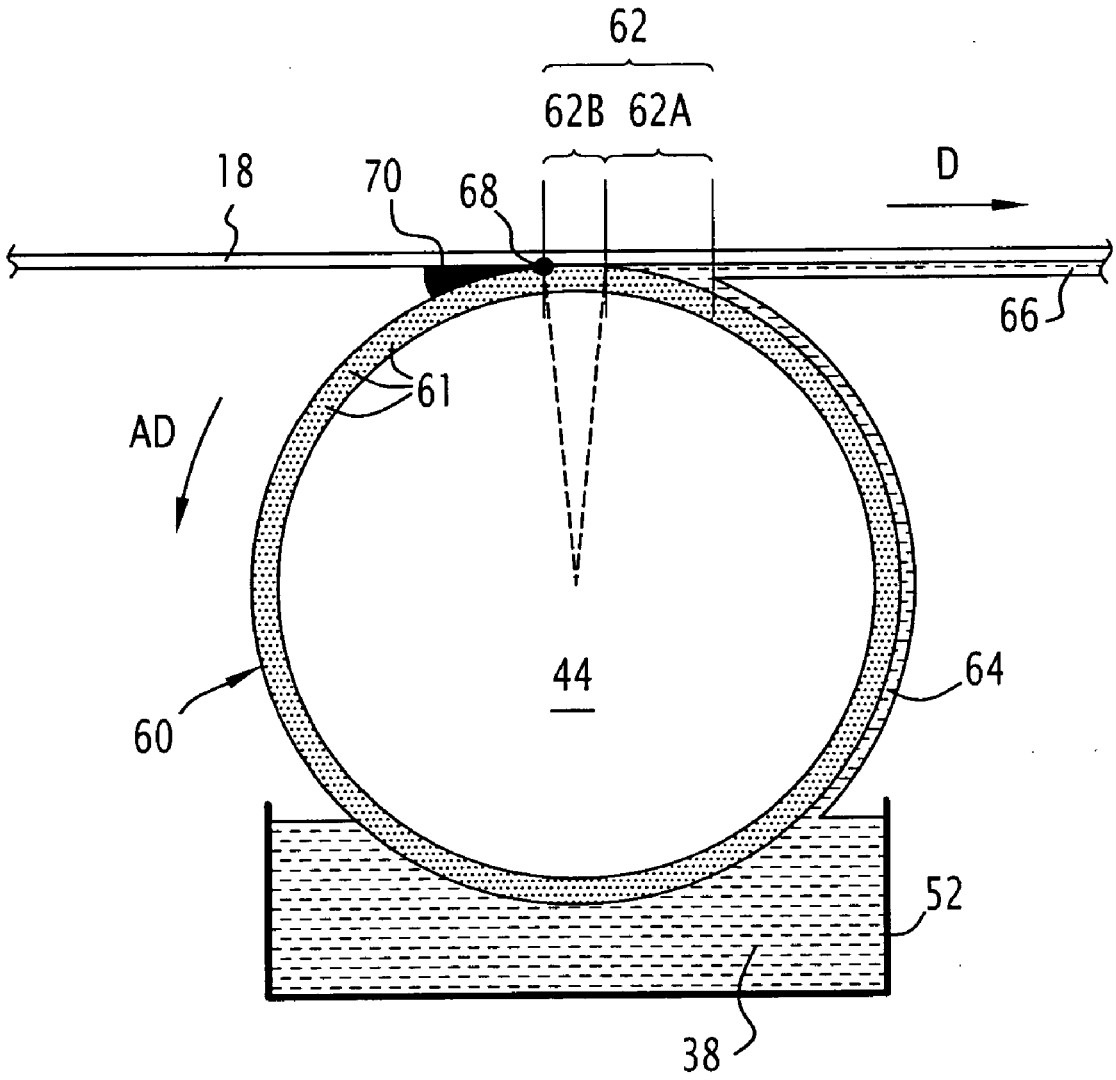

FIG. 4 depicts in a detailed manner the applicator roller 44 and the moistening liquid bath 52.

The applicator roller 44 has an outer cylindrical application surface 60, which forms an application surface for the moistening liquid 38 and which is made of a material adapted to produce a corona effect 70 on the paper web 18.

The material of the outer surface 60 is for example a plastic having a fluorine component. In a preferred embodiment, the material of the outer surface 60 is Poly-tetra-fluorine-ethylene (PTFE). The material of this embodiment also has the advantage of a low adherence of the ink, so that ink build-up on the application surface 60 is eliminated.

The applicator roller 44 defines a horizontal contact zone 62 with a first side of the paper web 18.

When driven by the motor 48, the applicator roller 44 receives a layer 64 of moistening liquid from the bath 52 and conveys this liquid layer 64 to the contact zone 62. The contact zone 62 is divided into a liquid application zone 62A and a dry zone 62B. In the liquid application zone 62A the liquid layer 64 is applied to the paper web 18 forming a liquid film 66 on the web 18. At the dry zone 62B of the contact zone 62, which is upstream with respect to the paper web travel direction D of the liquid application zone 62A, the applicator roller 64 and the paper web 18 are dry. The friction between the paper web 18 and the applicator roller 60 in the dry zone 62B of the contact zone 62 creates a discharge of static electricity between the applicator surface 60 and the paper web 18. This discharge of static electricity creates a corona 70 that lowers the surface tension of the paper web 18 and improves therefore the transfer of the liquid film 64 from the roller 60 to the web 18. Also, the corona 70 further lowers ink build-up.

The applicator roller 46 works in an identical manner as the applicator roller 44 with the only differences that the contact zone between the applicator roller 46 and the paper web 18 is vertical and that the contact zone is defined on a second side of the paper web 18.

The applicator rollers 44, 46 according to the invention result in an evenly distributed liquid film 66 on the paper web 18. The liquid film 64 is transferred in its entirety to the paper web 18 and the ink stays on the paper web.

According to another embodiment of the invention, the application surface 60 is made of a material other than PTFE, for example polyethylene. More generally speaking all other plastics material can be used to create the corona effect.

According to another embodiment of the invention, the application roller 44, 46 comprises an outer layer made of the PTFE material and an inner core made of a material different from the PTFE material.

According to another variant, means for creating the corona are arranged upstream of the liquid applicator roller in the paper web travel direction. In this case, the roller can be driven in the paper web travel direction and be of a material other than plastic.

What is claimed is:

1. A device for applying a moistening liquid to a paper web, comprising:

a liquid applicator roller for applying the moistening liquid on the paper web at a liquid application zone, the liquid applicator roller including an application surface; and means for creating a corona effect by discharge of static electricity on the paper web upstream of the liquid application zone, the means for creating a corona effect comprise the application surface, the application surface being formed of a material creating the corona effect on the paper web between the application surface and the paper web.

2. The device as recited in claim 1 wherein the material is a plastics material.

3. The device as recited in claim 2 wherein the material contains fluorine.

4. The device as recited in claim 3 wherein the material includes polytetrafluorineethylene (PTFE).

5. The device as recited in claim 1 wherein the device is adapted to convey the paper web in a paper web travel direction and to rotationally drive the applicator roller in a roller direction against the paper web travel direction.

6. The device as recited in claim 1 wherein the liquid applicator roller comprises an outer layer defining the application surface and made of the material creating the corona effect and an inner core made of a material that is different from the material of the outer layer.

* * * * *